US005323939A

United States Patent [19]

Young

[11] Patent Number: 5,323,939

[45] Date of Patent: Jun. 28, 1994

[54] AUTOMATIC DUMPING HOPPER

[75] Inventor: Francis M. Young, Waco, Tex.

[73] Assignee: Young Brothers, Inc., Waco, Tex.

[21] Appl. No.: 897,139

[22] Filed: Jun. 11, 1992

[51] Int. Cl.[5] ..... D06F 39/02

[52] U.S. Cl. ..... 222/463; 222/500; 406/23

[58] Field of Search ..... 222/52, 463, 498, 500; 406/19-21, 23, 24, 31-33

[56] References Cited

U.S. PATENT DOCUMENTS

| | | | |
|---|---|---|---|
| 1,112,636 | 10/1914 | McNeill | 406/23 |
| 2,740,562 | 4/1956 | Bello | 222/500 |
| 3,018,025 | 1/1962 | Wonn | 222/500 |
| 3,048,304 | 8/1962 | Polzin | 222/500 |
| 3,105,527 | 10/1963 | Mageux | 222/500 |
| 3,888,391 | 6/1975 | Merz | 222/500 |

*Primary Examiner*—David M. Mitchell
*Assistant Examiner*—Stephen P. Avila
*Attorney, Agent, or Firm*—Diller, Ramik & Wight

[57] ABSTRACT

An automatic dumping hopper mechanism includes a hopper of an asymmetrical configuration relative to a vertical axis which is mounted for pivoting movement about a horizontal axis with a door normally closing a discharge opening at a lower end of the hopper. A linkage is provided to effect opening and closing movement of the door upon pivotal movement of the hopper. The hopper is so constructed, arranged and disposed as to effect its movement automatically to the dumping position in response to a predetermined amount of material being charged therein.

23 Claims, 3 Drawing Sheets

AUTOMATIC DUMPING HOPPER

BACKGROUND OF THE INVENTION

This invention is directed to improvements in an automatic dumping "batch" or "gob" hopper that is filled from the top with aggregate material by utilizing a conventional conveyor. Heretofore such batch or gob hoppers required the use of so-called high bin limit switches which, when activated, caused the hoppers to dump through the operation of associated solenoids, servo motors, air cylinders, hydraulic dump cylinders and/or other activation devices. Obviously, should the high bin limit switch fail to react the hopper would not dump and the material would simply spill over the open top of the hopper in an undesired manner. More importantly, if the high bin limit switch operates prematurely the amount of material discharged from the hopper would be less than that required or desired or vice versa. Therefore the accuracy of the volume/weight of the material which is to be dumped is susceptible to undesired variations. The latter can occur quite frequently when it is recognized that such switches are utilized in adverse environments in which dust and dirt from the material which is being handled can cause switches to stick with the contacts thereof in either an open or closed position. Obviously, maintenance is a problem, not only of such limit switches, but also of associated servo motors, solenoids, air cylinders, hydraulic dump cylinders and the like.

SUMMARY OF THE INVENTION

In keeping with the foregoing, the novel automatic dumping "batch" or "gob" hopper of the present invention dumps automatically once a predetermined volume of material deposited therein is reached, and the dumping occurs in the absence of any type of height or volume sensing and in the absence of any type of external input energy and/or activation devices for causing the dumping operation to occur. Instead the hopper is constructed asymmetrically relative to a vertical axis and is mounted for pivotal movement about a horizontal axis with a pivotally mounted door normally closing a discharge end and/or opening of the hopper. The door or gate is connected through a linkage or pitman to the hopper and upon a predetermined volume/weight of material being introduced into the hopper, the hopper automatically pivots, as does the door, to open the discharge opening, discharge the material from the hopper, and upon the latter being accomplished, the hopper and door automatically return to their original closed positions at which successive refilling and dumping of the hopper can occur in a repetitive and continuing manner.

With the above, and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
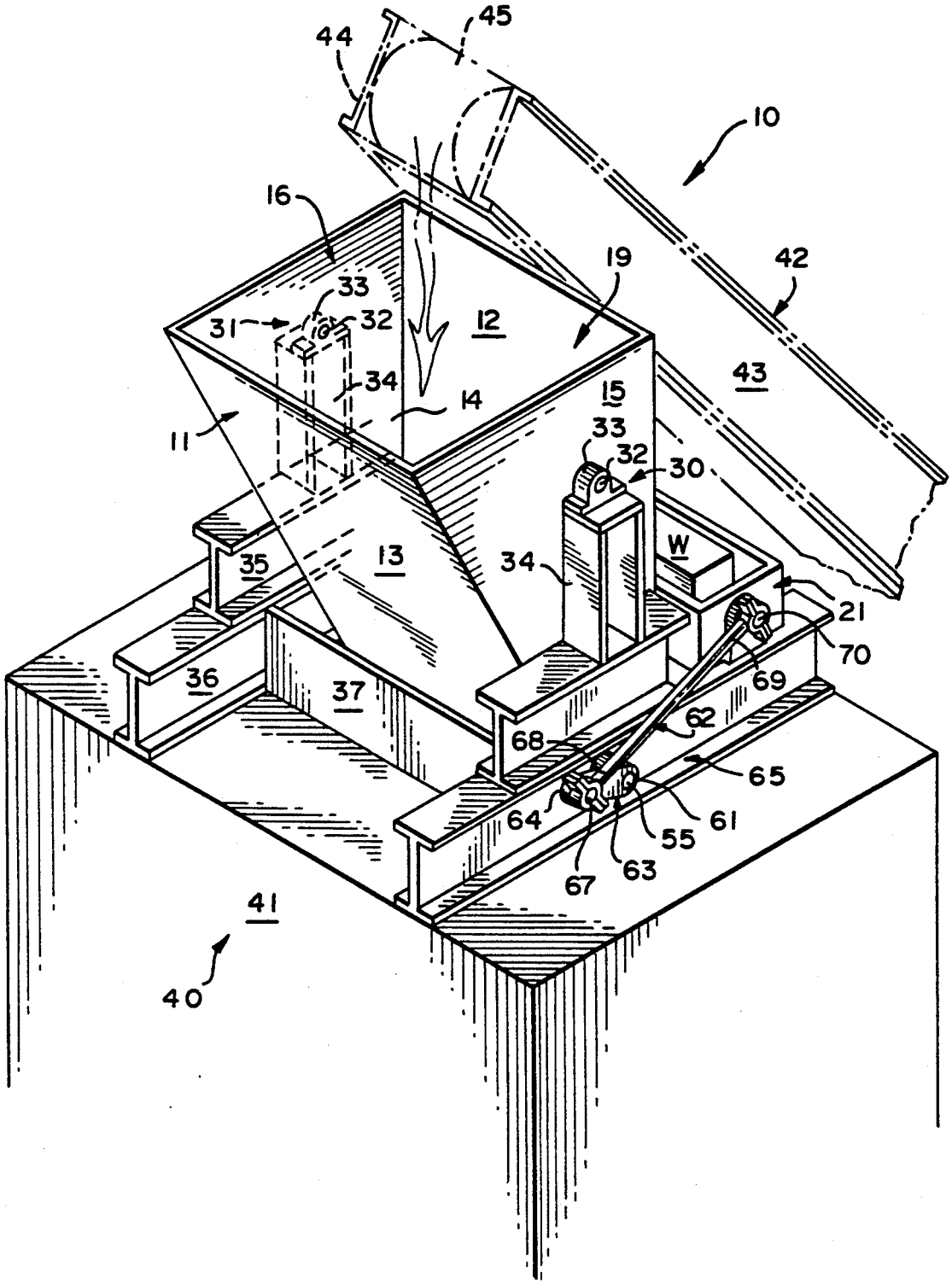
FIG. 1 is a top perspective view of a novel automatic dumping hopper mechanism of the present invention, and illustrates in phantom outline a conveyor for delivering material to an upper open end of an asymmetrical hopper which is pivoted about a horizontal axis with one of a pair of linkages being illustrated for effecting relative pivotal movement between the hopper and an associated discharge door.

An novel automatic dumping hopper mechanism constructed in accordance with this invention is generally designated by the reference numeral 10 and is of the "batch" or "gob" type. Hopper mechanisms of the latter type are filled to a predetermined capacity, generally as determined by an appropriate sensing switch, and then discharge the "batch" or "gob" of material housed therein, hence the name, "batch" or "gob" hopper mechanism.

Figure 2:
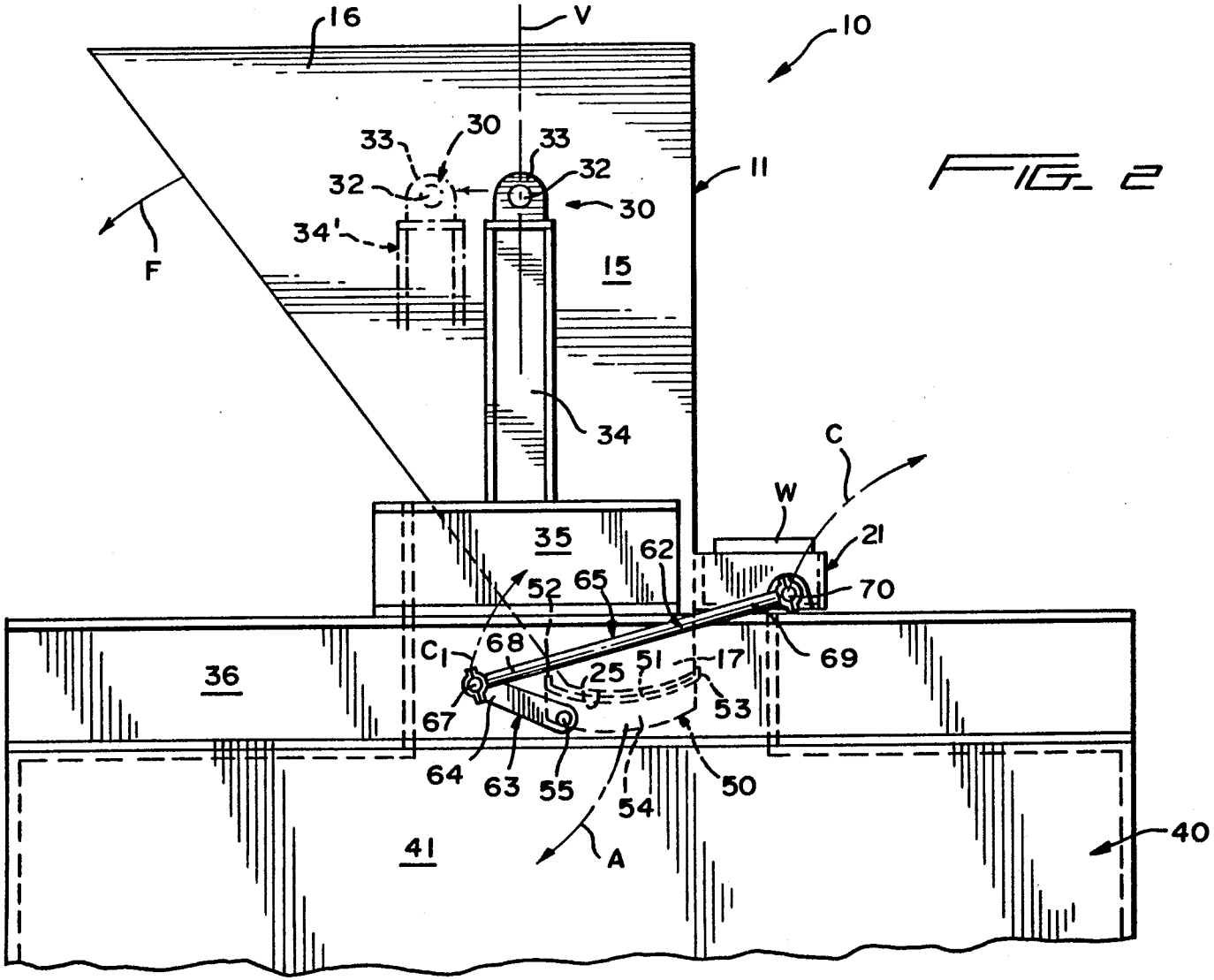
FIG. 2 is a side elevational view of the automatic dumping hopper mechanism of FIG. 1, and illustrates one of the linkages connected to the discharge door.
Figure 3:
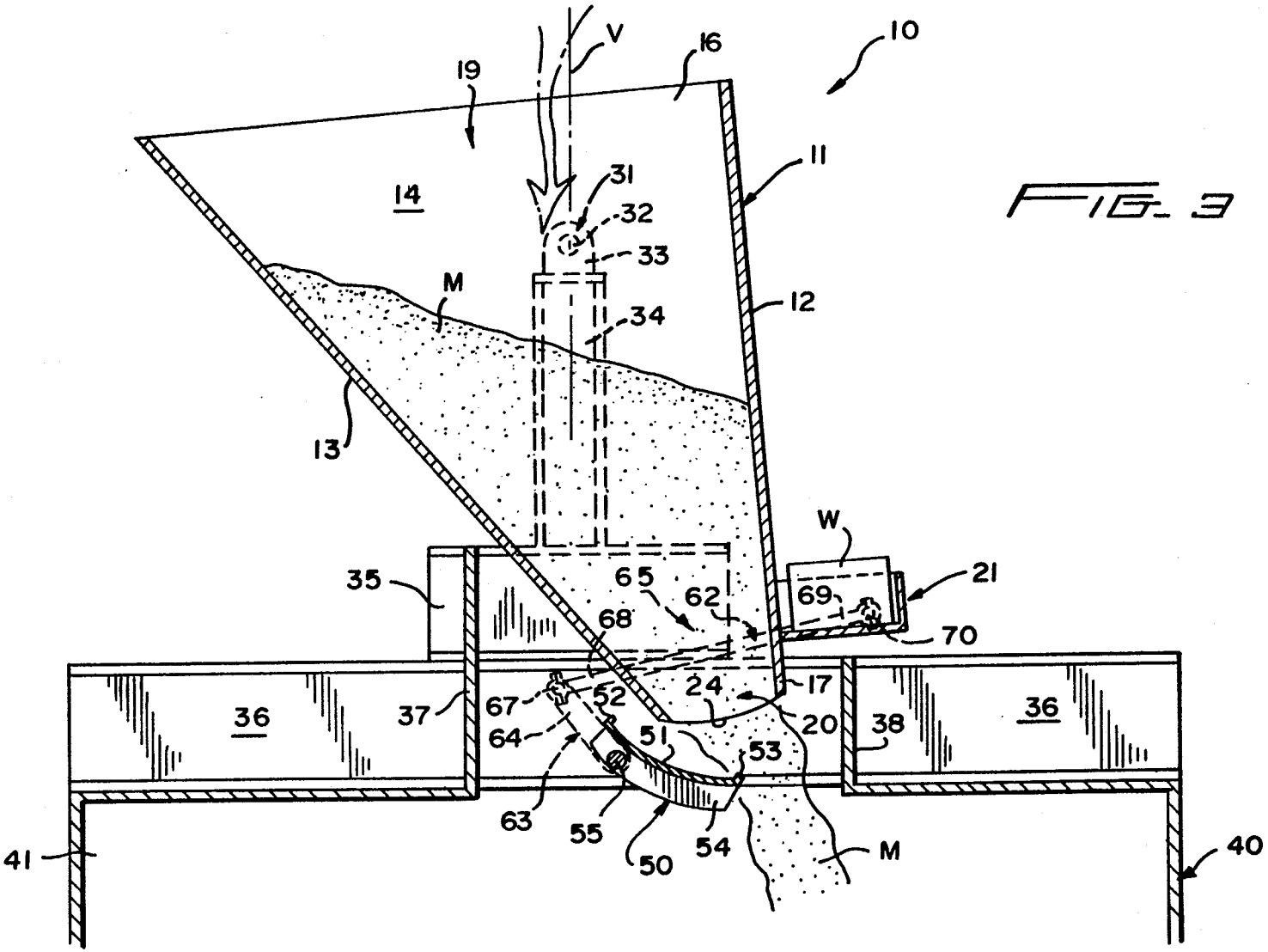
FIG. 3 is a vertical cross sectional view taken through the automatic dumping hopper mechanism of FIG. 2, and illustrates details of the door, its pivotal mounting about an associated shaft and the connection of two arms of the linkage between the door shaft and the hopper.

The automatic dumping hopper mechanism 10 includes a hopper 11 of an asymmetrical configuration/construction which is defined by first and second opposite generally rectangular walls 12, 13, respectively, and opposite generally frusto-conical sidewalls 14, 15 collectively defining an interior chamber 19, an upper end portion or end 16 and a lower end portion or end 17 defining a discharge opening 20. The discharge opening 20 is in turn also defined by opposite convex edges 24, 25 of the respective side walls 14, 15 (FIGS. 2 and 3). Means 21 for counterbalancing the hopper 11 is carried by the lower end 17 of the hopper 11 and projects to the right, as viewed in each of the figures. The counterbalancing means 21 is an upwardly opening tray housing one or more weights W which function as counterweights to automatically return the hopper to the closed position (FIG. 2) after material M, such as stone, aggregate, bitumen, hot mix or the like, has been completely discharged therefrom.

The hopper 11 is mounted for pivotal movement by pivot mounting means 30, 31 which are identical and are associated with the respective side walls 14, 15. The pivot mounting means 30, 31 each includes a shaft 32 rigidly secured to each of the side walls 14, 15 and mounted for rotation relative to bearings (not shown) in journals 33 carried by vertical supports or standards 34 each welded to an I-beam 35 which is in turn welded to an I-beam 36. The I-beams 35, 36 are disposed in generally parallel relationship to each other (FIG. 1) and are transversely rigidified by cross plates 37, 38 welded therebetween, as is best illustrated in FIG. 3. The elements 34–38 rest atop an upper end portion 41 of a tower 40, such as a hot mix storage bin beneath which trucks, railroad cars or the like can be driven to be batch loaded from the hopper 11. The material M is delivered to the hopper 11 by a conventional conveyor mechanism 42 supported between appropriate frames 43, 44 journaling therebetween a driven belt conveyor 45. The material M travels upwardly from right-to-left in FIG. 1 on an upper flight or run (unnumbered) of the conveyor belt 45 and discharges into the upper end 16 of the hopper 11 in the manner indicated by the unnumbered arrow associated therewith in FIGS. 1 and 3 causing the material M to progressively accumulate within the hopper 11.

A vertical axis V is illustrated in FIGS. 2 and 3 passing through the axis of the shafts 32. The position of the vertical axis or plane V is so chosen relative the asymmetrical configuration of the hopper 11 and the position and weight of the counterweights W and the counterbalance 21 so as to hold the hopper 11 closed when empty, and move to the open or discharging position only when sufficient material M has accumulated in the interior chamber 19 so as to overcome or override the counterweight or counterbalancing means 21. Essentially this means that the material M which accumulates to the left of the vertical plane V as viewed in FIG. 2, and the lever arm created thereby relative to the pivots 30 must be greater than and overcome the combined weights of the material M to the right of the vertical plane V and the counterbalancing means 21. When the latter occurs the hopper pivots counterclockwise as is evident from a comparison of FIGS. 2 and 3 which essentially is the motion of the hopper 11 from its closed non-dumping position to its open dumping position, respectively.

The discharge opening 20 of the hopper 11 is normally closed by a door or gate 50 defined by a curved plate 51 matching the edges 24, 25 and having upturned ends 52, 53 which embrace the respective walls 12, 13 in the closed position (FIG. 2) of the door 50. A plurality of downwardly projecting reinforcing ribs 54 are welded to the underside of the plate 51 and the ribs 54 are in turn welded or otherwise secured to a shaft 55 defining means for mounting the door for pivot movement relative to the hopper 11 between a first closed position (FIG. 2) and a second open position (FIG. 3). The shaft or pivot mounting means 55 is in turn pivotally mounted for rotation in bearings of journals (not shown) carried by the opposite I-beams 36. Thus the opposite axial ends (unnumbered) of the shaft 55 are mounted for rotation relative to the I-beams 36 and these opposite ends project outwardly of the I-beams 36 and are each connected to pitman arm means or linkage means 65 defined by a first link or arm 62 and a second link or arm 63. The end of each shaft 55 is connected to a first end 61 of a link 63 while a second end 64 of a link 63 is connected by a movable pivot connection 67 to an end 68 of a link 62. An opposite end 69 of each link 62 is freely pivotally connected to a pivot or stub shaft 70 which is in turn fixed to the counterbalancing means 21. Thus, the linkage 65 adjacent each of the walls 14, 15 is of an identical construction, is essentially perfectly aligned, and is symmetrically constructed relative to each other and the various components to which they are associated. Thus, as the material M reaches a desired volume/weight within the interior chamber 19, an effective resultant vector force F (FIG. 2) is created tending to pivot the hopper 11 about the pivot shafts 30 in a counterclockwise direction, again as viewed in FIG. 2. This counterclockwise pivoting of the hopper 11 about the shafts or pivots 30 essentially begins lifting the stub shafts 70 about a curved arc C (FIG. 2) which in turn moves the pivots 67 along the curved arc C1 resulting in clockwise pivoting of the arm 63 and clockwise rotation of the shaft 55 resulting in opening movement of the door or gate 50 generally along an arc of travel A from the closed position shown in FIG. 2 to the open position shown in FIG. 3 during which material M discharges from the discharge opening 20, as shown in FIG. 3. Once the material M has discharged from the hopper 11 the motion just described is reversed under the influence of the counterbalancing means 21 resulting in opposite movement of the links 62, 63, the counterclockwise rotation of the door 50 and the closure of the discharge opening 20 (FIG. 2).

Various modifications may be made to the automatic dumping hopper mechanism 10 in accordance with the present invention. For example, the counterbalancing means 21 shown in FIG. 3 as a tray containing the weights W can instead be a solid piece of steel which is welded or otherwise secured along the wall 12 of the hopper 11. However, this construction prevents individual weights W from being placed in or removed from the tray to vary the opening the hopper 11 in dependence upon a desired variable predetermined volume of the material M accumulating therein. Similarly, the two linkages 65 are constructed to effect maximum opening of the door or gate 10 with minimum pivoting of the hopper 11. However, variations in the relative movement of the hopper 11 and the door 50 can be achieved by varying the lengths of the arms or links 62, 63, as well as the location of the stub shaft 70 relative to the counterbalancing means 21 and the shaft 55 relative to the bottom edges 24, 25 or the discharge opening 20 of the hopper 11.

It is obvious from the foregoing that a certain amount of weight is required to quickly return the hopper 11 from its dumping position (FIG. 3) back to its original upright position (FIG. 2) after the dumping operation. In lieu of changing the weights W, one can shift the axis of the pivots 30 to the left or to the right of the vertical plane V shown in FIG. 2. In FIG. 2 a standard or support 34' is shown in phantom outline shifted to the left, as compared to the support 34, which increases the amount of material M required before the hopper 11 dumps. If the point of pivot 30 was moved to the right of the vertical plane V, less material M accumulating in the hopper 11 would cause the hopper 11 to dump the material therein. Accordingly, rather than weld the shafts or pivots 30 to the walls 14, 15 of the hopper 11, the shafts 30 can be selectively bolted by appropriate brackets to the walls 14, 15 in such a fashion as to allow the same to be shifted to the left, as shown in phantom outline, or to the right of the vertical plane V to thereby selectively vary the dumping of the hopper 11 dependent upon the material M accumulated therein. Obviously the latter can be achieved with or without a change in the linkages or lever arms 62, 63, although simultaneous shifting of the pivots 32 and, for example, a lengthening or shortening of the link or arm 62 can be undertaken to cause cumulative forces to effect varied opening and closing of the closing of the hopper 11. For example, if the links 62 were lengthened, more force or more weight of the material M would be required to cause the hopper Il to dump, and if one were to desire a still further increase in hopper loading before dumping, the pivots 32 could also be moved further to the left of the vertical plane V, as shown in phantom outline in FIG. 2. This combination would require maximum material M to accumulate in the hopper 11 before dumping. Correspondingly, if the arms 62 were shortened and the pivots 30 were moved to the right of the vertical plane V, a minimum amount of material M within the hopper 11 would effect the pivoting thereof to open the door 50 and effect material dumping.

The automatic dumping hopper mechanism 10 just described provides a very accurate method of regulating the quantity of material which accumulates in the hopper 11 before it trips and dumps. In this way the prior art sensors, solenoids, air cylinders, hydraulic cylinders or the like are unnecessary, and all that may be required would be a simple counter to maintain accurate accounts of dumped quantities. The latter would be particularly useful for stockpiling materials or for dumping a predetermined number of hoppers per truckload.

Although a preferred embodiment of the invention has been specifically illustrated and described herein, it is to be understood that minor variations may be made in the apparatus and the method without departing from the spirit and scope of the invention as defined in the appended claims.

I claim:

1. An automatic dumping hopper mechanism comprising a hopper, said hopper having a charging end through which material is adapted to be charged into said hopper and a discharging end through which material is adapted to be discharged from said hopper, said discharging end having a discharging opening, a door, means mounting said door for movement relative to said hopper between first and second positions at which said discharging opening is respectively closed and open, means mounting said hopper for movement relative to said door between first and second positions at which said discharging opening is respectively closed and open, means coupled between said hopper and said door for effecting substantially contemporaneous movement thereof for at least a portion of the movement of each between the respective first and second positions thereof; and said hopper mounting means being so constructed, arranged and disposed to effect movement of said hopper from the first to the second position thereof automatically in response to a predetermined amount of material being charged therein.

2. The automatic dumping hopper mechanism as defined in claim 1 wherein said hopper is of an asymmetrical configuration.

3. The automatic dumping hopper mechanism as defined in claim 1 wherein said hopper is of an asymmetrical configuration relative to a vertical axis.

4. An automatic dumping hopper mechanism as defined in claim 1 wherein said hopper mounting means is a pivot mounting means.

5. An automatic dumping hopper mechanism as defined in claim 1 wherein said door mounting means is a pivot mounting means.

6. An automatic dumping hopper mechanism as defined in claim 1 wherein said hopper mounting means and said door mounting means are each a pivot mounting means.

7. An automatic dumping hopper mechanism as defined in claim 1 wherein said hopper mounting means is a substantially horizontally disposed pivot mounting means.

8. An automatic dumping hopper mechanism as defined in claim 1 wherein said door mounting means is a substantially horizontally disposed pivot mounting means.

9. An automatic dumping hopper mechanism as defined in claim 1 wherein said hopper mounting means and said door mounting means are each a substantially horizontally disposed pivot mounting means.

10. An automatic dumping hopper mechanism as defined in claim 1 wherein including means for movably connecting said coupled means to both said door and said hopper.

11. An automatic dumping hopper mechanism as defined in claim 1 wherein including means for pivotally connecting said coupled means to both said door and said hopper.

12. An automatic dumping hopper mechanism as defined in claim 1 wherein said coupled means is a linkage defined by first and second arms, first ends of said first and second arms are connected to said hopper and door respectively, and second ends of said first and second arms are connected to each other.

13. An automatic dumping hopper mechanism as defined in claim 1 including means for counterbalancing said hopper for movement toward its first position.

14. An automatic dumping hopper mechanism as defined in claim 1 including means for counterbalancing said hopper for movement toward its first position.

15. An automatic dumping hopper mechanism as defined in claim 1 wherein said hopper discharging end has a generally curved contour which is substantially matched by a generally curved contour of said door.

16. An automatic dumping hopper mechanism as defined in claim 1 wherein said coupled means is a linkage defined by first and second arms, first ends of said first and second arms are connected to said hopper and door respectively, and second ends of said first and second arms are connected to each other, said second arm first end and door being rigidly connected to each other, and said door mounting means pivotally mounts said second arm and door for simultaneous pivotal movement.

17. An automatic dumping hopper mechanism as defined in claim 6 wherein said coupled means is a linkage defined by first and second arms, first ends of said first and second arms are connected to said hopper and door respectively, and second ends of said first and second arms are connected to each other.

18. An automatic dumping hopper mechanism as defined in claim 6 wherein said hopper discharging end has a generally curved contour which is substantially matched by a generally curved contour of said door.

19. An automatic dumping hopper mechanism as defined in claim 6 wherein said coupled means is a linkage defined by first and second arms, first ends of said first and second arms are connected to said hopper and door respectively, and second ends of said first and second arms are connected to each other, said second arm first end and door being rigidly connected to each other, and said door mounting means pivotally mounts said second arm and door for simultaneous pivotal movement.

20. An automatic dumping hopper mechanism as defined in claim 19 wherein said hopper discharging end has a generally curved contour which is substantially matched by a generally curved contour of said door.

21. The automatic dumping hopper mechanism as defined in claim 1 including conveying means for delivering material into said hopper charging end.

22. The automatic dumping hopper mechanism as defined in claim 21 wherein said hopper charging end is located elevationally above said hopper discharging end.

23. The automatic dumping hopper mechanism as defined in claim 22 wherein said conveying means is an endless conveyor.

* * * * *